US009139012B2

(12) United States Patent
Yamada et al.

(10) Patent No.: US 9,139,012 B2
(45) Date of Patent: Sep. 22, 2015

(54) INK FILLING APPARATUS AND INK FILLING METHOD

(71) Applicant: CANON KABUSHIKI KAISHA, Tokyo (JP)

(72) Inventors: Ryota Yamada, Chiba (JP); Akira Shiba, Machida (JP); Isamu Yoneda, Oita (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/510,751

(22) Filed: Oct. 9, 2014

(65) Prior Publication Data

US 2015/0109377 A1 Apr. 23, 2015

(30) Foreign Application Priority Data

Oct. 17, 2013 (JP) ..... 2013-216386

(51) Int. Cl.
*B41J 2/195* (2006.01)
*B41J 2/175* (2006.01)

(52) U.S. Cl.
CPC ..... *B41J 2/17506* (2013.01)

(58) Field of Classification Search
USPC ..... 347/7, 84, 85, 86; 141/2, 7, 18, 39, 59; 53/432, 468
See application file for complete search history.

(56) References Cited

U.S. PATENT DOCUMENTS

| | | | | |
|---|---|---|---|---|
| 6,058,984 | A * | 5/2000 | Sato | 141/7 |
| 6,238,042 | B1 * | 5/2001 | Kobayashi et al. | 347/86 |
| 6,447,109 | B1 | 9/2002 | Williamson et al. | 347/85 |
| 6,539,985 | B2 * | 4/2003 | Shinada et al. | 141/2 |
| 7,513,613 | B2 * | 4/2009 | Ishizawa et al. | 347/86 |
| 7,686,438 | B2 * | 3/2010 | Ogawa et al. | 347/86 |
| 8,286,669 | B2 | 10/2012 | Yoneda | 141/2 |
| 2012/0216491 | A1 | 8/2012 | Yoneda et al. | 53/452 |
| 2012/0227861 | A1 | 9/2012 | Shiba et al. | 141/5 |
| 2013/0255826 | A1 | 10/2013 | Qing et al. | 141/2 |

FOREIGN PATENT DOCUMENTS

| | | |
|---|---|---|
| JP | 08-207299 | 8/1996 |
| JP | 906830 | 4/1999 |

(Continued)

OTHER PUBLICATIONS

U.S. Appl. No. 14/458,109 filed Aug. 12, 2014; Group Art No. 2853.

(Continued)

*Primary Examiner* — Anh T. N. Vo
(74) *Attorney, Agent, or Firm* — Fitzpatrick, Cella, Harper & Scinto

(57) ABSTRACT

The present invention enables a suitable ink filling state of an ink tank to be achieved by setting ink filling conditions taking prevention of ink leakage during unsealing of an ink supply port into account. An ink tank includes a first storage chamber formed in the ink tank to store an ink absorber, and a second storage chamber also formed in the ink tank to substantially form a closed space except for a communication section communicating with the first storage chamber. After the pressure in the ink tank is reduced to a target pressure through an atmospheric communicating port, the ink tank is internally filled, through an ink supply port, with a target filling amount of ink associated with the target pressure.

6 Claims, 6 Drawing Sheets

(56) References Cited

FOREIGN PATENT DOCUMENTS

| | | |
|---|---|---|
| JP | 1080918 | 3/2001 |
| WO | 2012/083644 | 6/2012 |

OTHER PUBLICATIONS

Great Britain Search and Examination Report dated Mar. 23, 2015 in counterpart Great Britain Patent Application No. 1418384.2.

* cited by examiner

START
S1
PROVIDE AND POSITION INK TANK (10)
S2
BRING TIGHT CONTACT MEMBER (112, 114) INTO CONTACT WITH INK TANK (10)
S3
OPEN VALVE (132)
S4
HAS PRESSURE DETECTED BY BAROMETER (104) REACHED TARGET PRESSURE (P1)?
NO
YES
S5
CLOSE VALVE (132)
S6
OPEN VALVE (134)
S7
PERFORM INK FILLING OPERATION USING SYRINGE (122)
S8
CLOSE VALVE (134)
S9
SWITCH THREE-WAY VALVE (130) (L-C: CLOSED, R-C: OPEN)
PRESSURE REDUCTION STEP
FILLING STEP

INK FILLING APPARATUS AND INK FILLING METHOD

BACKGROUND OF THE INVENTION

1. Field of the Invention

The present invention relates to an ink filling apparatus and an ink filling method in which an ink tank including a storage chamber that stores ink via an ink absorber and a storage chamber that directly stores ink is filled with ink.

2. Description of the Related Art

Some ink tanks configured to supply ink to an ink jet print head have a first storage chamber including an ink absorber serving as a negative pressure generating member to store ink via the ink absorber, and a second storage chamber that directly stores ink. The first storage chamber includes an ink supply port and an atmospheric communicating port. The second storage chamber is a substantially closed space that is in communication only with the first storage chamber. The second storage chamber directly contains ink. As an ink filling method for such an ink tank, a method has been proposed which involves filling the ink tank with ink by reducing the pressure in the ink tank as described in U.S. Pat. No. 6,447,109 and Japanese Patent Laid-Open No. H08-207299(1996).

According to the method described in U.S. Pat. No. 6,447,109, a reduction in the pressure in the ink tank, filling of ink, and cancellation of the pressure reduction are performed through a communicating port formed on an upper surface of the ink tank. According to the method described in Japanese Patent Laid-Open H08-207299(1996), the pressure in the ink tank is reduced, using a vacuum pump, though the atmospheric communicating port positioned on the upper surface of the ink tank, while the ink tank is filled with ink through the ink supply port positioned on a lower surface of the ink tank.

SUMMARY OF THE INVENTION

In the first aspect of the present invention, there is provided an ink filling apparatus configured to fill an ink tank with ink, the ink tank comprising a first storage chamber that contains an ink absorber, a second storage chamber that substantially forms a closed space except for a communication section communicating with the first storage chamber, a first port for supplying ink externally from the first storage chamber, and a second port for providing fluid communication between the atmosphere and the first storage chamber, the ink filling apparatus comprising:

a pressure reduction unit configured to reduce pressures in the first storage chamber, the second storage chamber, and the communication section to a target pressure through the second port; and a filling unit configured to fill the first storage chamber, the second storage chamber, and the communication section with a target filling amount of ink through the first port after the pressures in the first storage chamber, the second storage chamber, and the communication section have been reduced to the target pressure by the pressure reduction unit, wherein the target pressure is a pressure set such that a compressed volume of gas remaining in the second chamber, after (a) the reduction of pressure in the first storage chamber, second storage chamber and communication section to the target pressure by the pressure reduction unit, (b) the filling of the tank with the target filling amount of ink by the ink filling unit and (c) application of atmospheric pressure via the second port to the ink in the first storage chamber, is less than a limited volume, and the target filling amount is less than or equal to a total of a volume of ink absorbable by the absorber, a volume of the second storage chamber, and a volume of the communication section minus the compressed volume.

In the second aspect of the present invention, there is provided an ink filling method for filling an ink tank with ink, the ink tank comprising a first storage chamber that contains an ink absorber, a second storage chamber that substantially forms a closed space except for a communication section communicating with the first storage chamber, a first port for supplying ink externally from the first storage chamber, and a second port for providing fluid communication between the atmosphere and the first storage chamber, the ink filling method comprising:

a pressure reduction step of reducing pressures in the first storage chamber, the second storage chamber, and the communication section to a target pressure through the second port;

a closing step of closing the second port;

a filling step of filling the first storage chamber, the second storage chamber, and the communication section with a target filling amount of ink through the first port; and a pressure application step of applying atmospheric pressure via the second port to the ink in the first storage chamber, wherein the target pressure is a pressure set such that a compressed volume of gas remaining in the second storage chamber, after the pressure reduction step, closing step, filling step and pressure application step, is less than a limited volume, and the target filling amount is less than or equal to a total of a volume of ink absorbable by the absorber, a volume of the second storage chamber, and a volume of the communication section minus the compressed volume.

Further features of the present invention will become apparent from the following description of exemplary embodiments (with reference to the attached drawings).

DESCRIPTION OF THE EMBODIMENTS

When starting to use the ink tank, a user of the ink tank removes a seal that seals the ink supply port. At this time, it is necessary to prevent ink from leaking through the ink supply port. U.S. Pat. No. 6,447,109 and Japanese Patent Laid-Open No. H08-207299(1996) include no description concerning filling of the ink tank with ink with prevention of ink leakage upon unsealing of the ink supply port taken into account.

The present invention provides an ink filling apparatus and an ink filling method in which a suitable ink filling state of an ink tank can be achieved by setting ink filling conditions taking prevention of ink leakage upon unsealing of the ink supply port into account.

An embodiment of the present invention will be described below with reference to the drawings.

Figure 1:
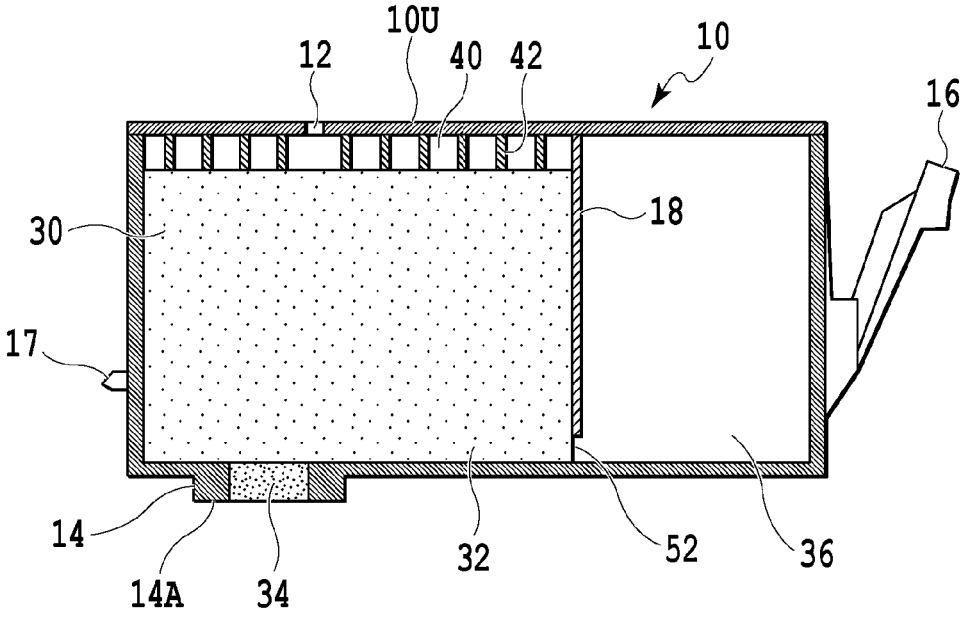
FIG. 1 is a cross-sectional view of an ink tank to which an ink filling method according to the present invention is applicable.

FIG. 1 is a cross-sectional view illustrating an internal structure of an ink tank 10 according to the embodiment. The ink tank 10 includes a first storage chamber 30 and a second storage chamber 36 which are partitioned by a bulkhead 18. The first storage chamber 30 is in communication with atmosphere at an upper portion of the first storage chamber 30 via an atmospheric communicating port 12 and includes an ink supply port 14A formed at a lower portion of the first storage chamber 30. In the first storage chamber 30, an ink absorber 32 serving as a negative pressure generating member is accommodated. An ink supply cylinder 14 forming the ink supply port 14A includes a pressure contact member 34 provided in the ink supply cylinder 14. The pressure contact member 34 exerts a stronger capillary force and having a higher physical strength than the absorber 32. The pressure contact member 34 is in pressure contact with the absorber 32. The second storage chamber 36 is a substantially closed space that is in communication only with the first storage chamber 30 via a communicating section 52. An upper wall 10U of the ink tank 10 forming the first storage chamber 30 includes a plurality of ribs 42 projecting into the first storage chamber 30. The ribs 42 are in abutting contact with the absorber 32. An air buffer chamber 40 is formed between the upper wall 10U and the absorber 32. The ink tank 10 is attached to an ink tank installation section of a printing apparatus (not shown in the drawings) using a locking lever 16 and a locking projection 17.

Figure 2:
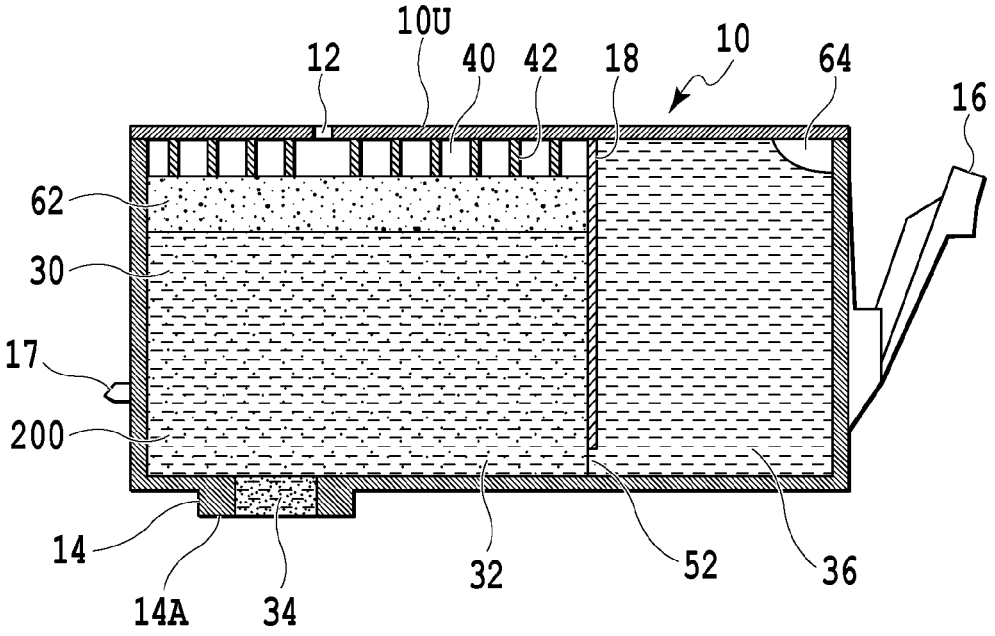
FIG. 2 is a cross-sectional view illustrating an ink filling state in the ink tank in FIG. 1.

FIG. 2 is a diagram illustrating that the ink tank 10 is filled with the ink.

The second storage chamber 36 that directly stores ink 200 is desirably filled with the ink 200 over as wide an area as possible. However, filling the ink over the entire area of the second storage chamber 36 is difficult in practice and bubble(s) 64 remain. If the bubble(s) 64 have an excessively large volume, when the user removes a seal that seals the ink supply port 14A under an decompression environment where the atmospheric pressure is lower than when the ink tank 10 is filled with the ink, the bubble(s) 64 may expand to cause the ink to leak through the ink supply port 14A. To prevent such ink leakage, the volume (limited volume) of bubble(s) (gas) 64 permitted to remain in the second storage chamber 36 is set, and the volume of the bubble(s) 64 is kept smaller than the limited volume.

In the first storage chamber 30, the pressure contact member 34 and a portion of the absorber 32 near the pressure contact member 34 need to be sufficiently filled with the ink 200 in order to continuously supply the ink to an ink jet print head. Furthermore, an upper portion of the absorber 32 is an area (hereinafter also referred to as "an ink wetted area") 62 which is temporarily impregnated with the ink 200 and from which the ink 200 is then removed. The area 62 is located in the upper portion of the absorber 32 to exhibit an ink absorbing capability to absorb the ink moving in the ink tank as a result of a change in environment, thus restraining possible ink leakage.

FIGS. 3A to 3E are diagrams illustrating an ink filling method.

Figure 3A:
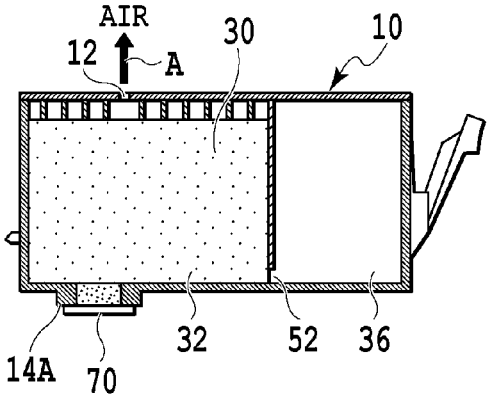
FIG. 3A, FIG. 3B, FIG. 3C, FIG. 3D, and FIG. 3E are diagrams illustrating operation steps of the ink filling method according to the present invention.

First, in a pressure reduction step in FIG. 3A, the ink tank 10 configured as described above is provided in an atmospheric environment, and the ink supply port 14A is closed. In the present example, a seal member 70 is attached to the ink supply port 14A to close the ink supply port 14A. Communication between the inside of the ink tank 10 and the external atmospheric environment through the ink supply port 14A may be blocked. A method for blocking such a communication is not limited to a method using the seal member 70. Subsequently, as shown by arrow A, the air inside the ink tank 10 is sucked through the atmospheric communicating port 12 to reduce the pressure in the ink tank 10 to a target pressure.

Figure 3B:
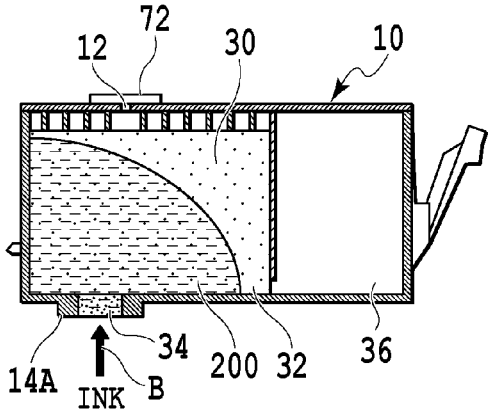
Figure 3C:
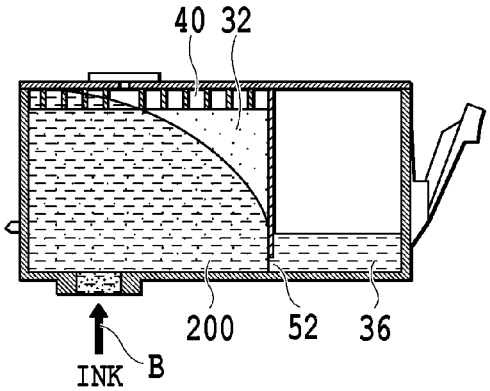
Figure 3D:
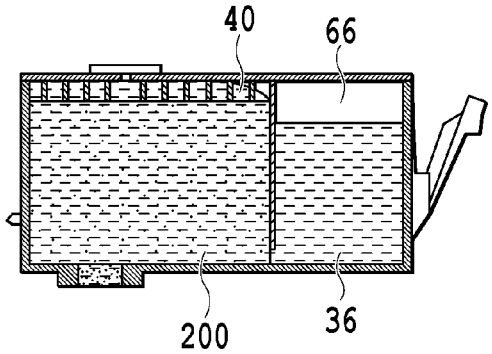

Then, in filling steps in FIGS. 3B to 3D, first, while the ink tank 10 with the pressure therein reduced to the target pressure in the above-described pressure reduction step is kept in a pressure reduced state, the atmospheric communicating port 12 is closed and the ink supply port 14A is unclosed (FIG. 3B). Before the ink supply port 14A is unclosed, an ink filling path described below is connected to the ink supply port 14A. In the present example, a seal member 72 is attached to the atmospheric communicating port 12 to close the atmospheric communicating port 12. A communication path between the inside of the ink tank 10 and the external atmospheric environment through the atmospheric communicating port 12 may be blocked. A method for blocking such a communication path is not limited to a method using the seal member 72.

The ink supply port 14A connected to the ink filling path is unclosed (opened) to start filling the ink tank 10 with the ink 200 in the pressure reduced state through the ink supply port 14A as shown by arrow B in FIG. 3B and FIG. 3C. Once ink filling has started, the ink first infiltrates through the pressure contact member 34 to the absorber 32. As shown in FIG. 3C, continuing such ink filling allows the infiltrating ink 200 to reach the air buffer chamber 40 and the communication section 52, and the air buffer chamber 40 and the second storage chamber 36 are filled with the ink 200 through the ink supply port 14A via the absorber 32. When a specified amount of ink is fed, the ink 200 infiltrates throughout the absorber 32 and fills in approximately the entire area in the air buffer chamber 40 as shown in FIG. 3D. Furthermore, the second storage chamber 36 is filled with the ink 200, with a space (unfilled space) 66 left in the second storage chamber 36 in which the ink 200 is not filled. The unfilled space 66 remains in the pressure reduced state even after the filling steps for the ink 200 because the pressure in the ink tank is reduced before the ink filling steps.

Figure 3E:
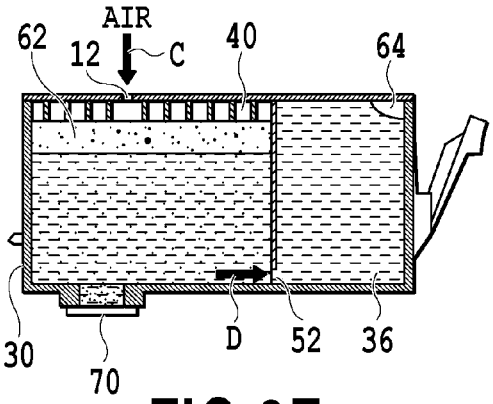

Subsequently, in an atmosphere open steps in FIG. 3E, the ink supply port 14A is closed with the atmospheric communicating port 12 kept closed. In the present example, the seal member 70 is attached to the ink supply port 14A to close the ink supply port 14A. A communication path between the inside of the ink tank 10 and the external atmospheric environment through the ink supply port 14A may be blocked. The method for blocking such a communication path is not limited to the method using the seal member 70. Subsequently, unclosing the atmospheric communicating port 12 allows the atmosphere to be introduced into the first storage chamber 30 through the atmospheric communicating port 12 as shown by arrow C based on a difference between the atmospheric pressure and the pressure in the unfilled space 66 in the pressure reduced state. The unfilled space 66 is compressed by the atmospheric pressure to cause the ink 200 in the first storage chamber 30 to move through the communication section 52 into the second storage chamber 36 as shown by arrow D. Such movement of the ink 200 allows the ink 200 remaining in the air buffer chamber 40 to be absorbed by the absorber 32. Moreover, such movement of the ink 200 progresses to draw the ink 200 from the upper portion of the absorber 32 to form the ink wetted area 62. Then, when the pressure in the compressed unfilled space 66 is equal to the atmospheric pressure, the movement of the ink 200 stops. The compressed unfilled space 66 remains as the bubble(s) 64 (see FIG. 2) in the second storage chamber 36. Thus, the filling of the ink 200 is completed.

Now, operation conditions for the ink filling steps will be described.

Conditions will be described which are set in order to realize the ideal filling state in implementing the filling method.

The volume of the first storage chamber 30 minus the volume of fibrous materials of the absorber 32 and the pressure contact member 34 is denoted by Vs. The sum of the volumes of the absorber 32 and the pressure contact member 34 minus the volume of the fibrous materials of the absorber 32 and the pressure contact member 34 is denoted by Va. Furthermore, the total volume of the second storage chamber 36 and the communication section 52 is denoted by Vi. For the pressures, the atmospheric pressure is denoted by P0, and the target pressure to which the pressure in the ink tank is reduced during the pressure reduction step is denoted by P1. The volume of the bubble(s) 64 (see FIG. 2) remaining in the second storage chamber 36 is denoted by V1. The limited volume of the bubbles 64 is denoted by Vx. A target filling amount for the ink 200 during the ink filling steps is denoted by W.

First, a condition will be described which is needed to set the volume V1 of the bubbles 64 remaining in the second storage chamber 36 to less than the limited volume Vx.

When the atmosphere is assumed to be an ideal gas, the volume V1 of the bubbles 64 is determined in accordance with Formula (1) based on the law that the product of the pressure and the volume of a gas is constant (Boyle's law).

(Formula 1)

$$V1 = \frac{(Vs + Vi)P1}{P0} \tag{1}$$

In Formula (1), (Vs+Vi) denotes the total of the volume (Vs) of a space area in the first storage chamber 30 and the total volume (Vi) of the second storage chamber 36 and the communication section 52. The volume (Vs+Vi) in the ink tank 10 is changed to the bubbles 64 with the compressed volume V1 when the volume (Vs+Vi) is compressed by the atmospheric pressure P0 after the pressure in the ink tank 10 is reduced to the target pressure P1. In other words, the volume of gas (Vs+Vi) (FIG. 3A) in the ink tank at the pressure P1 is compressed, after the tank is filled with ink, by the applied atmospheric pressure P0 to the volume V1 (FIG. 3E). The condition for setting the compressed volume V1 less than the limited volume Vx is expressed by Formula (2).

(Formula 2)

$$P1 < \frac{Vx}{Vs + Vi}P0 \tag{2}$$

The compressed volume V1 of the bubbles 64 can be made less than the limited volume Vx by setting the target pressure P1 during the pressure reduction step lower than a value (right side of formula 2) determined from the volumes Vs, Vi, and Vx and the atmospheric pressure P0.

Now, a condition for forming the ink wet area 62 will be described.

The target filling amount W of the ink with which the ink tank 10 is to be filled needs to be adjusted to an amount at which the ink is prevented from overflowing from the absorber 32 into the air buffer chamber 40 even when the bubbles 64 with the compressed volume V1 remain in the second storage chamber 36. Thus, the target filling amount W of the ink needs to meet Formula (3).

(Formula 3)

$$W < Vi + Va - V1 \tag{3}$$

The compressed volume V1 of the bubbles 64 in Formula (3) is determined using Formula (1).

Now, a specific example of setting of the ink target filling amount W will be described.

For the ink tank 10 in the present example, the volume Vs equal to the volume of the first storage chamber 30 minus the volume of the fibrous materials in the absorber 32 and the pressure contact member 34 is 8.0 cc. Furthermore, the volume Va equal to the sum of the volumes of the absorber 32 and the pressure contact member 34 minus the volume of the fibrous materials in the absorber 32 and the pressure contact member 34 is 5.5 cc. Additionally, the total volume Vi of the second storage chamber 36 and the communication section 52 is 5.0 cc, and the limited volume Vx of the bubbles 64 permitted to remain is 0.2 cc. The atmospheric pressure P0 during ink filling is 101.3 kPa.

First, the target pressure P1 during the pressure reduction step is calculated using the set limited volume Vx of the bubbles 64 and Formula (2). The right side of Formula (2) is calculated to be 1.56 kPa from the volumes Vs, Vi, and Vx and the atmospheric pressure P0. The target pressure P1 may be set lower than this value (1.56 kPa). In the present example, the target pressure P1 is set to 1.0 kPa.

Then, the ink target filling amount W is calculated using Formula (1) and Formula (3). First, Formula (1) is used to calculate the compressed volume V1 of the bubbles 64 remaining in the second storage chamber 36 at the target pressure of 1.0 kPa to be 0.13 cc. The compressed volume V1 and Formula (3) allow the optimum ink target filling amount W to be calculated to be 10.37 cc. Based on the result of the calculation, in the present example, the actual ink filling amount is set to 9.5 cc.

Figure 4:
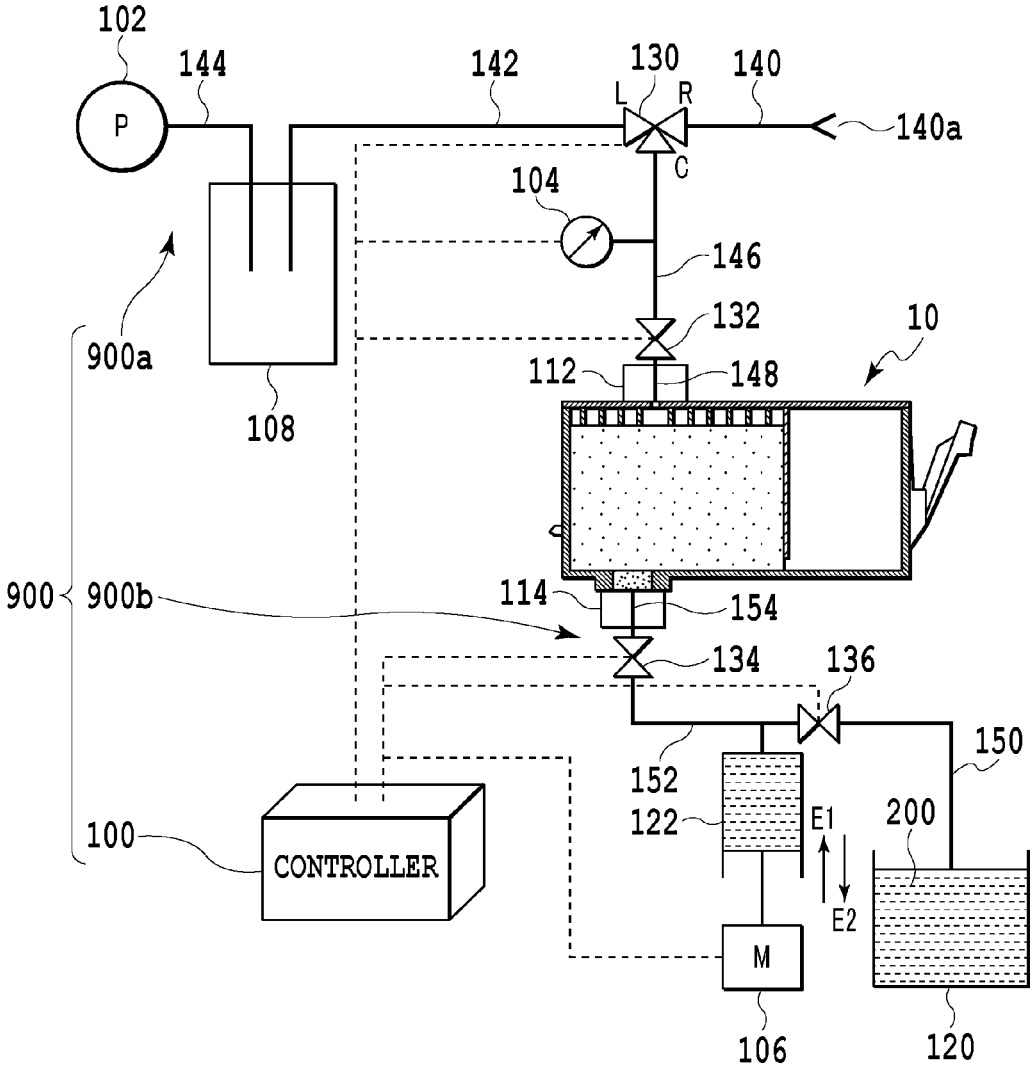
FIG. 4 is a schematic diagram of a configuration of an ink filling apparatus according to the present invention.

FIG. 4 is a schematic diagram of a filling apparatus 900 configured to fill the ink tank 10 with the ink.

The ink filling apparatus 900 includes a pressure reduction unit 900*a*, a filling unit 900*b*, a fixing jig (not shown in the drawings), and a controller 100. The pressure reduction unit 900*a* is connected to the atmospheric communicating port 12 positioned in the upper portion of the ink tank 10 to reduce the pressure in the ink tank 100. The filling unit 900*b* is connected to the ink supply port 14A positioned in the lower portion of the ink tank 10 to fill the ink tank 10 with the ink 200.

In the pressure reduction unit 900*a*, a vacuum pump 102, a buffer tank 108, a barometer 104, a three-way valve 130, a valve 132, and a tight contact member 112 are connected together via lines 140, 142, 144, 146, and 148. In the filling unit 900*b*, an ink reservoir 120, a syringe 122, a motor 106, valves 134 and 136, and a tight contact member 114 are connected together via lines 150, 152, and 154. One end 140*a* of the line 140 and the ink reservoir 120 are open to the atmosphere. The barometer 104, the motor 106, the three-way valve 10, and the valves 132, 134, and 136 are electrically connected to the controller 100. The controller 100 enables determination of measured values from the barometer and control of operations of the motors and the valves.

Figures 5, 5A, 5B:
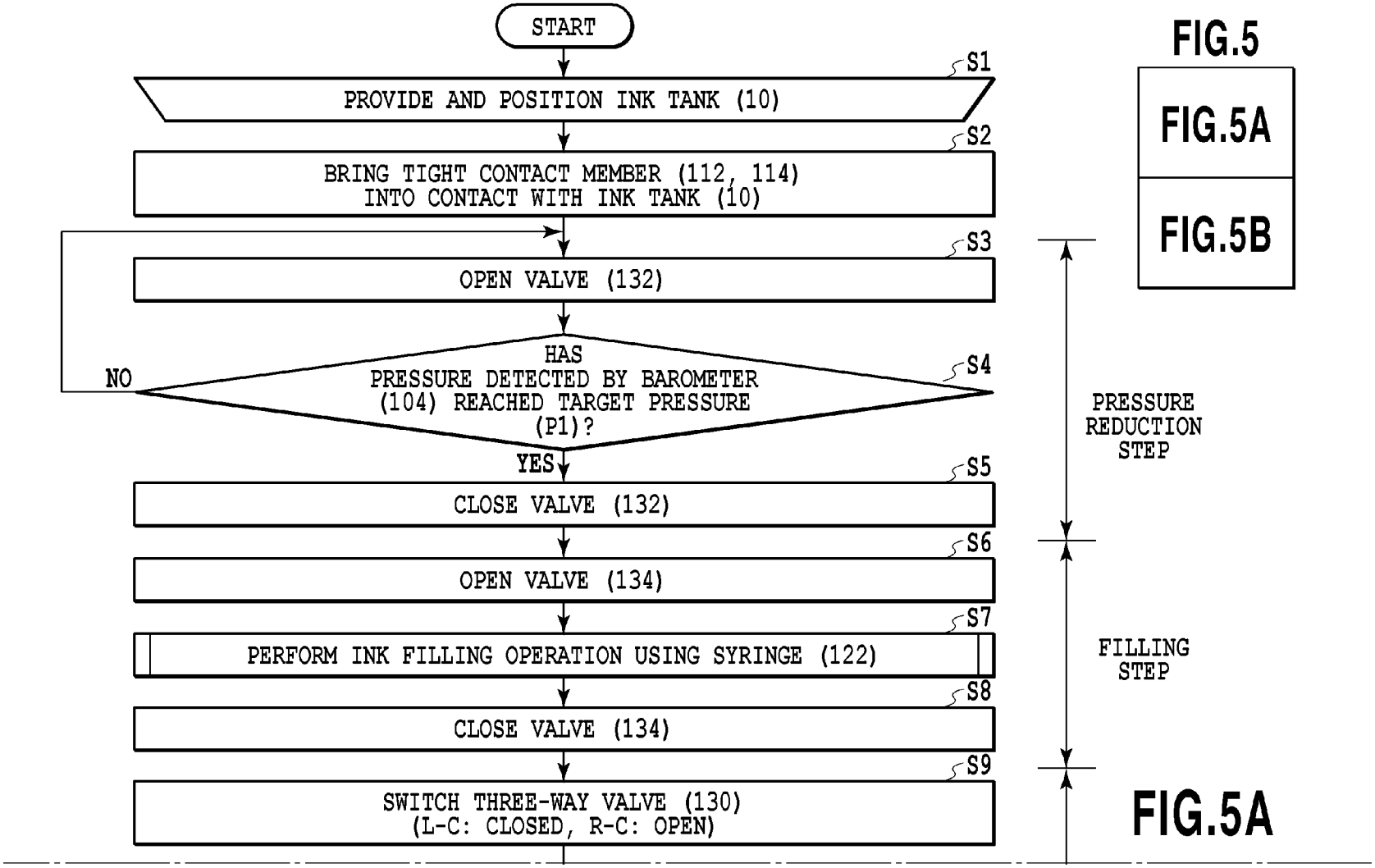
FIG. 5 is a diagram showing a relation between FIG. 5A and FIG. 5B.
FIG. 5A and FIG. 5B are flowcharts illustrating the ink filling method according to the present invention.
Figure 5B:
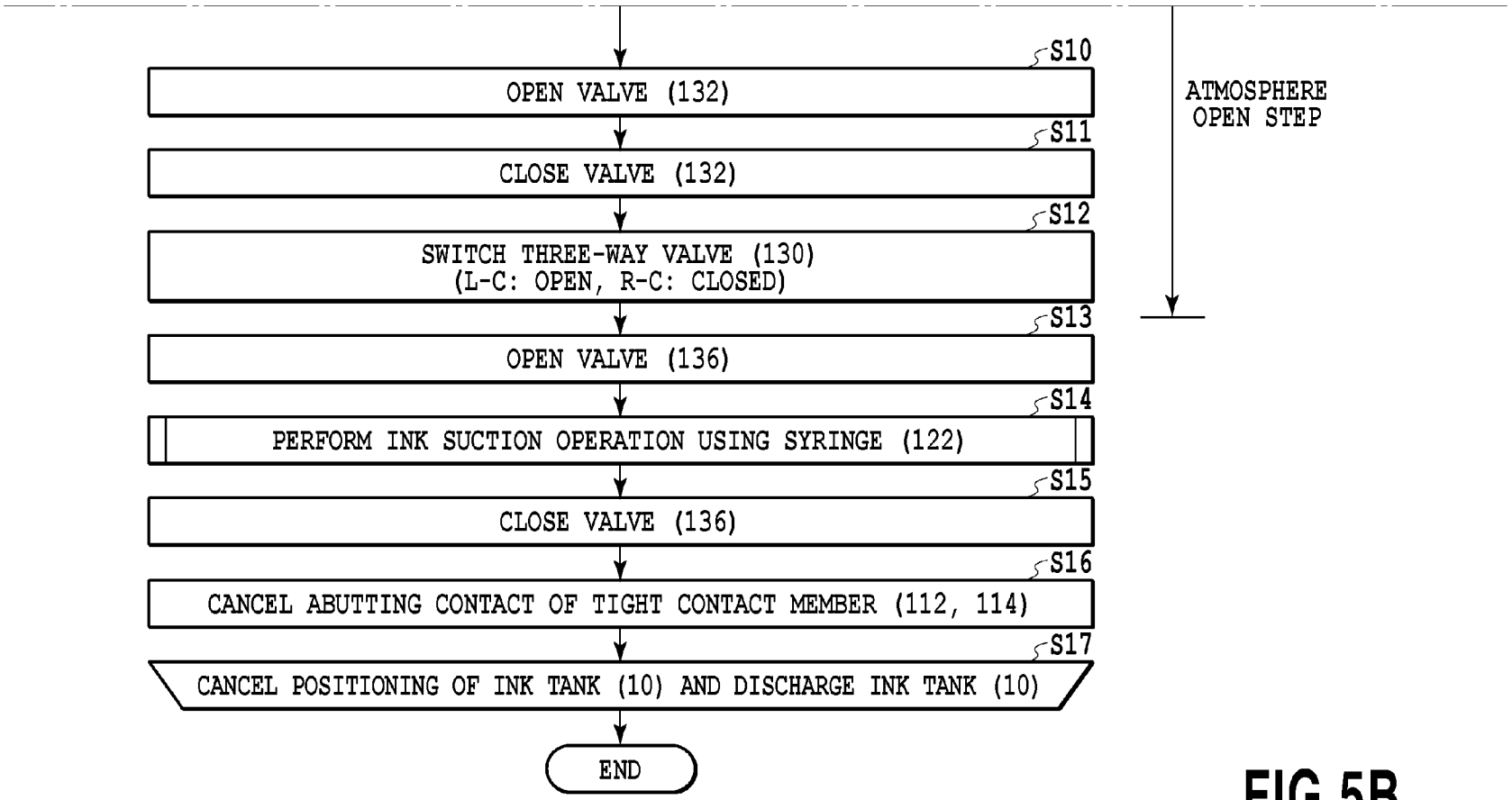

Now, with reference to a flowchart shown in FIG. 5, operation of the ink filling apparatus 900 under the control of the controller 100 will be described.

First, in step S1, the ink tank 10 is provided to the fixing jig (not shown in the drawings) and positioned with the ink supply port 14A located on the lower side. In step S2, the tight contact member 112 is brought into tight contact with the opening of the atmospheric communicating port 12 to connect the line 148 to the atmospheric communicating port 12. The tight contact member 114 is brought into tight contact with the opening of the ink supply port 14A to connect the line 154 to the ink supply port 14A. The line 148 may be a channel formed inside the tight contact member 112. Similarly, the line 154 may be a channel formed inside the tight contact member 114.

Then, pressure reduction steps (steps S3, S4, and S5) are executed. In the present example, the vacuum pump 102 is constantly driven to keep the inside of the buffer tank 108 in the pressure reduced state. First, in step S3, the valve 132 is opened to start reducing the pressure in the ink tank 10 through the buffer tank 108 and the three-way valve 130. Thus, the pressure in the ink tank 10 gradually decreases. Then, step S4 determines, based on the pressure detected by the barometer 103, whether or not the pressure in the ink tank 10 has reached the target pressure P1 (in the present embodiment, 1.0 kPa). When the pressure in the ink tank 10 has reached the target pressure P1, the process shifts to step S5 to close the valve 132 to stop reducing the pressure in the ink tank 10. Therefore, the valve 132 is kept open until the pressure in the ink tank 10 reaches the target pressure P1, continuing to reduce the pressure in the ink tank 10.

Then, the filling steps (steps S6, S7, and S8) are executed. First, in step S6, the valve 134 is opened, and immediately after the opening, the motor 106 is used to move a piston in the syringe 122 forward in a direction of arrow E1 (step S7). At this time, the valve 136 remains closed. Thus, the ink tank 10 is filled with a predetermined target filling amount W (in the present embodiment, 9.5 cc) of ink through the lines 152 and 154 and the tight contact member 114. The ink 200 with which the ink tank 10 is filled at this time flows into the first storage chamber 30 and the second storage chamber 36 as shown in FIGS. 3B to 3D described above. In the present example, the valve 132 blocks the communication between the inside of the ink tank 10 and the external atmospheric environment through the ink supply port 14A, and thus, the ink 200 also flows into the line 148. After the ink tank 10 is filled with the predetermined amount of ink 200, the valve 134 is closed in step S8.

Then, the atmosphere open steps (steps S9, S10, S11, and S12) are executed. First, in step S9, the three-way valve 130 is switched from a communication state between ports L and C to a communication state between ports R and C. In other words, a path between the ports L and C is closed, and a path between the ports R and C is opened. Thus, the atmosphere flows into the lines 140 and 146. Then, in step S10, the valve 132 is opened to allow the atmosphere to flow into the ink tank 10 in the pressure reduced state. At this time, the ink 200 having flowed into the line 148 is pushed back into the ink tank 10 in conjunction with the movement of the atmosphere. Then, as shown in FIG. 3E described above, the unfilled space 66 is compressed by the atmospheric pressure and remains as the bubbles 64, with the ink wetted area 62 formed in the upper portion of the absorber 32. After the atmosphere flows into the ink tank 10, the valve 132 is closed in step S11, and the three-way valve 130 is switched from the communication state between the ports R and C to the communication state between the ports L and C in step S12. In other words, the path between the ports R and C is closed and the path between the ports L and C is opened to recover the three-way valve 130 to the original state.

The filling of the ink tank 10 with the ink ends as described above. After the ink filling, the filling unit 900*b* performs a suction operation of filling the syringe 122 with the ink. First, in step S3, the valve 136 is opened, and in step S14, the motor 106 is used to move the piston in the syringe 122 backward in a direction of arrow E2. Thus, the ink 200 stored in the ink reservoir 120 is sucked to draw the target filling amount W (in the present embodiment, 9.5 cc) of ink into the syringe 122. Subsequently, in step S15, the valve 136 is closed.

Subsequently, to allow the ink tank 10 completely filled with the ink to be removed, the apparatus cancels, in step S16, the abutting contact of the tight contact member 112 with the atmospheric communicating port 12 and the abutting contact of the tight contact member 114 with the ink supply port 14A. In the subsequent step S17, the positioning of the ink tank 10 with the fixing jig is cancelled, and the ink tank 10 is removed. The series of operations ends as described above.

(Other Embodiments)

The target pressure may be a pressure at which the compressed volume, resulting from the compression, under the atmospheric pressure, of the total space area in the first storage chamber, the second storage chamber, and the communication section the pressures in which have been reduced to the target pressure, is less than the limited volume of the bubbles limited in the second storage chamber after the ink filling. Furthermore, the target filling amount may be an amount less than the total of the volume of ink absorbable by the absorber in the first storage chamber, the volume of the second storage chamber, and the volume of the communication section minus the above-described compressed volume.

Furthermore, various ink tanks including a storage chamber that stores ink via an ink absorber and a storage chamber that directly stores ink can be filled with ink. The ink tanks may be used to supply ink to various printing apparatuses including ink jet printing apparatuses.

The present invention also provides:

an ink filling apparatus configured to fill an ink tank with ink, the ink tank comprising a first storage chamber that stores an ink absorber, a second storage chamber that substantially forms a closed space except for a communication section communicating with the first storage chamber, an ink supply port through which ink in the first storage chamber is fed to an outside, and an atmospheric communicating port through which atmosphere is introduced into the first storage chamber, the ink filling apparatus comprising:

a pressure reduction unit configured to reduce pressures in the first storage chamber, the second storage chamber, and the communication section to a target pressure through the atmospheric communicating port; and a filling unit configured to fill the first storage chamber, the second storage chamber, and the communication section with a target filing amount of ink through the ink supply port after the pressures in the first storage chamber, the second storage chamber, and the communication section have been reduced to the target pressure by the pressure reduction unit, wherein the target pressure is a pressure at which a compressed volume, resulting from compression, by an atmospheric pressure, of a total space area in the first storage chamber, the second storage chamber, and the communication section the pressures in which have been reduced to the target pressure, is less than a limited volume of bubbles limited in the second storage chamber after the ink filling, and the target filling amount is equal to a total of a volume of ink absorbable by the absorber, a volume of the second storage chamber, and a volume of the communication section minus the compressed volume.

Preferably the limited volume of the bubbles is a volume limited in order to restrain ink from leaking through the ink supply port when the ink supply port sealed after ink filling is unsealed.

Preferably the ink supply port contains a pressure contact member exerting a stronger capillary force than the absorber, and the volume of ink absorbable by the absorber includes a volume of ink absorbable by the pressure contact member.

Preferably a volume of the first storage chamber minus a volume of a material of the absorber is denoted by Vs, a volume of the absorber minus the volume of the material of the absorber is denoted by Va, a total volume of the second storage chamber and the communication section is denoted by Vi, the compressed volume is denoted by V1, the limited volume of the bubbles is denoted by Vx, the atmospheric pressure is denoted by P0, the target pressure is denoted by P1, and the target filling amount is denoted by W, the target pressure P1 and the target filling amount W are expressed by following formulas.

$$P1 < \frac{Vx}{Vs + Vi} P0$$

$$W < Vi + Va - V1$$

$$\text{Where, } V1 = \frac{(Vs + Vi)P1}{P0}.$$

The present invention also provides:

an ink filling method for filling an ink tank with ink, the ink tank comprising a first storage chamber that stores an ink absorber, a second storage chamber that substantially forms a closed space except for a communication section communicating with the first storage chamber, an ink supply port through which ink in the first storage chamber is fed to an outside, and an atmospheric communicating port through which atmosphere is introduced into the first storage chamber, the ink filling method comprising:

a pressure reduction step of reducing pressures in the first storage chamber, the second storage chamber, and the communication section to a target pressure through the atmospheric communicating port; and a filling step of filling the first storage chamber, the second storage chamber, and the communication section with a target filing amount of ink through the ink supply port after the atmospheric communicating port is closed after the pressure reduction step, wherein the target pressure is a pressure at which a compressed volume, resulting from compression, by an atmospheric pressure, of a total space area in the first storage chamber, the second storage chamber, and the communication section the pressures in which have been reduced to the target pressure, is less than a limited volume of bubbles limited in the second storage chamber after the ink filling, and the target filling amount is equal to a total of a volume of ink absorbable by the absorber, a volume of the second storage chamber, and a volume of the communication section minus the compressed volume.

Preferably the limited volume of the bubbles is a volume limited in order to restrain ink from leaking through the ink supply port when the ink supply port sealed after ink filling is unsealed.

Preferably the pressure reduction step comprises reducing the pressures in the first storage chamber, the second storage chamber, and the communication section to the target pressure through a communication path connected to the atmospheric communicating port, and closing the atmospheric communicating port corresponds to closing the communication path.

Preferably a volume of the first storage chamber minus a volume of a material of the absorber is denoted by Vs, a volume of the absorber minus the volume of the material of the absorber is denoted by Va, a total volume of the second storage chamber and the communication section is denoted by Vi, the compressed volume is denoted by V1, the limited volume of the bubbles is denoted by Vx, the atmospheric pressure is denoted by P0, the target pressure is denoted by P1, and the target filling amount is denoted by W, the target pressure P1 and the target filling amount W are expressed by following formulas.

$$P1 < \frac{Vx}{Vs + Vi} P0$$

$$W < Vi + Va - V1$$

$$\text{Where, } V1 = \frac{(Vs + Vi)P1}{P0}.$$

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-216386, filed Oct. 17, 2013, which is hereby incorporated by reference herein in its entirety.

What is claimed is:

1. An ink filling apparatus configured to fill an ink tank with ink, the ink tank comprising a first storage chamber that contains an ink absorber, a second storage chamber that substantially forms a closed space except for a communication section communicating with the first storage chamber, a first port for supplying ink externally from the first storage chamber, and a second port for providing fluid communication between the atmosphere and the first storage chamber, the ink filling apparatus comprising:

a pressure reduction unit configured to reduce pressures in the first storage chamber, the second storage chamber, and the communication section to a target pressure through the second port; and a filling unit configured to fill the first storage chamber, the second storage chamber, and the communication section with a target filling amount of ink through the first port after the pressures in the first storage chamber, the second storage chamber, and the communication section have been reduced to the target pressure by the pressure reduction unit, wherein the target pressure is a pressure set such that a compressed volume of gas remaining in the second chamber, after (a) the reduction of pressure in the first storage chamber, second storage chamber and communication section to the target pressure by the pressure reduction unit, (b) the filling of the tank with the target filling amount of ink by the filling unit and (c) application of atmospheric pressure via the second port to the ink in the first storage chamber, is less than a limited volume, wherein the target filling amount is less than a total of a volume of ink absorbable by the absorber, a volume of the second storage chamber, and a volume of the communication section minus the compressed volume, and wherein a volume of the first storage chamber minus a volume of a material of the absorber is denoted by Vs, a volume of the absorber minus the volume of the material of the absorber is denoted by Va, a total volume of the second storage chamber and the communication section is denoted by Vi, the compressed volume is denoted by V1, the limited volume is denoted by Vx, the atmospheric pressure is denoted by P0, the target pressure is denoted by P1, and the target filling amount is denoted by W, and the target pressure P1 and the target filling amount W are expressed by following formulas $$P1 < \frac{Vx}{Vs + Vi} P0$$

$$W < Vi + Va - V1$$

$$\text{where, } V1 = \frac{(Vs + Vi)P1}{P0}.$$

2. The ink filling apparatus according to claim 1, wherein the limited volume is set in order to restrain ink from leaking through the first port upon unsealing of the first port by a user, after ink filling.

3. The ink filling apparatus according to claim 1, wherein the first port contains a pressure contact member exerting a stronger capillary force than the absorber, and the volume of ink absorbable by the absorber includes a volume of ink absorbable by the pressure contact member.

4. An ink filling method for filling an ink tank with ink, the ink tank comprising a first storage chamber that contains an ink absorber, a second storage chamber that substantially forms a closed space except for a communication section communicating with the first storage chamber, a first port for supplying ink externally from the first storage chamber, and a second port for providing fluid communication between the atmosphere and the first storage chamber, the ink filling method comprising:

a pressure reduction step of reducing pressures in the first storage chamber, the second storage chamber, and the communication section to a target pressure through the second port;

a closing step of closing the second port;

a filling step of filling the first storage chamber, the second storage chamber, and the communication section with a target filling amount of ink through the first port; and a pressure application step of applying atmospheric pressure via the second port to the ink in the first storage chamber, wherein the target pressure is a pressure set such that a compressed volume of gas remaining in the second storage chamber, after the pressure reduction step, closing step, filling step and pressure application step, is less than a limited volume, the target filling amount is less than a total of a volume of ink absorbable by the absorber, a volume of the second storage chamber, and a volume of the communication section minus the compressed volume, and wherein a volume of the first storage chamber minus a volume of a material of the absorber is denoted by Vs, a volume of the absorber minus the volume of the material of the absorber is denoted by Va, a total volume of the second storage chamber and the communication section is denoted by Vi, the compressed volume is denoted by V1, the limited volume is denoted by Vx, the atmospheric pressure is denoted by P0, the target pressure is denoted by P1, and the target filling amount is denoted by W, and the target pressure P1 and the target filling amount W are expressed by following formulas $$P1 < \frac{Vx}{Vs + Vi} P0$$

$$W < Vi + Va - V1$$

$$\text{where, } V1 = \frac{(Vs + Vi)P1}{P0}.$$

5. The ink filling method according to claim 4, wherein the limited volume is set in order to restrain ink from leaking through the first port upon unsealing of the first port by a user, after ink filling.

6. The ink filling method according to claim 4, wherein the pressure reduction step comprises reducing the pressures in the first storage chamber, the second storage chamber, and the communication section to the target pressure through a communication path connected to the second port, and closing the second port corresponds to closing the communication path.

* * * * *